United States Patent [19]

Kicherer

[11] Patent Number: 4,871,902

[45] Date of Patent: Oct. 3, 1989

[54] ELECTRIC HOTPLATE AND APPARATUS FOR THE CONNECTION THEREOF

[75] Inventor: Robert Kicherer, Oberderdingen, Fed. Rep. of Germany

[73] Assignee: E.G.O. Elektro-Gerate Blanc u. Fischer, Fed. Rep. of Germany

[21] Appl. No.: 930,492

[22] Filed: Nov. 12, 1986

[30] Foreign Application Priority Data

Nov. 16, 1985 [DE] Fed. Rep. of Germany ..... 3540815

[51] Int. Cl.[4] ..... H05B 3/68

[52] U.S. Cl. ..... 219/458; 219/451; 219/457

[58] Field of Search ..... 219/458, 447, 451, 452, 219/457, 458, 459, 463, 464, 541, 436, 351; 81/313

[56] References Cited

U.S. PATENT DOCUMENTS

| | | | |
|---|---|---|---|
| 2,696,747 | 12/1954 | Bergan | 81/313 |
| 4,048,877 | 9/1977 | Udin | 81/313 |
| 4,158,302 | 6/1979 | O'Loughlin | 81/313 |
| 4,650,969 | 3/1987 | Kicherer | 219/451 |
| 4,658,118 | 4/1987 | Kicherer | 219/451 |

FOREIGN PATENT DOCUMENTS

| | | |
|---|---|---|
| 0102015 | 8/1983 | European Pat. Off. . |
| 1143281 | 9/1963 | Fed. Rep. of Germany . |
| 1270201 | 6/1968 | Fed. Rep. of Germany . |
| 1291032 | 10/1969 | Fed. Rep. of Germany . |
| 1690557 | 6/1974 | Fed. Rep. of Germany . |
| 3301219 | 7/1984 | Fed. Rep. of Germany . |
| 2933349 | 9/1984 | Fed. Rep. of Germany . |
| 424291 | 2/1935 | United Kingdom . |

*Primary Examiner*—A. D. Pellinen
*Assistant Examiner*—Leon K. Fuller
*Attorney, Agent, or Firm*—Steele, Gould & Fried

[57] ABSTRACT

In an electric hotplate (1*b*), the connecting portions (19*b*) for the connection of appliance lines (34) provided on the underside thereof can be transferred about articulations, namely bendable or pivotable joints or hinges, e.g. in the form of springs (71) into a transportation and fitting position, in which they are completely countersunk in the underside of the hotplate and also do not project over the outer circumference thereof. The connecting portions (19*b*) can be transferred from this transportation and fitting position into a connecting position projecting both above the outer circumference and above the underside of hotplate (1*b*), in which they can be connected in a simple manner with a connecting piece (31) of the appliance lines (34). This ensures both an equiaxial automated stacking of the hotplates and an automated fitting of the hotplate in a hob or the like in simple manner.

78 Claims, 10 Drawing Sheets

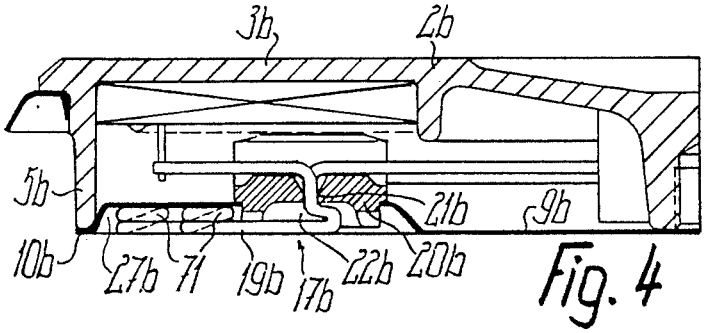
Fig. 4
Fig. 5
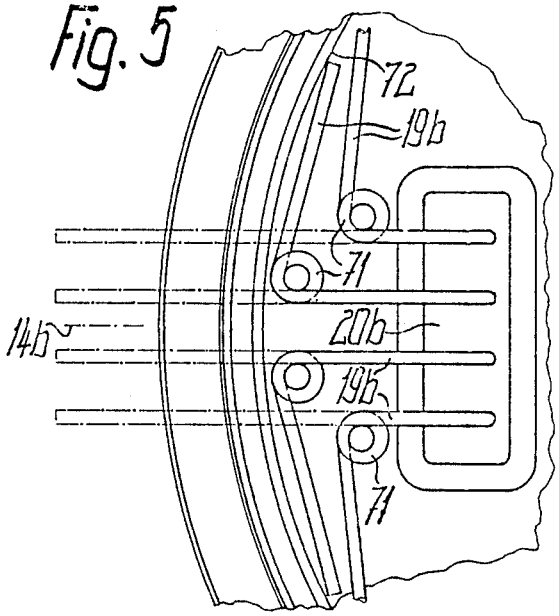
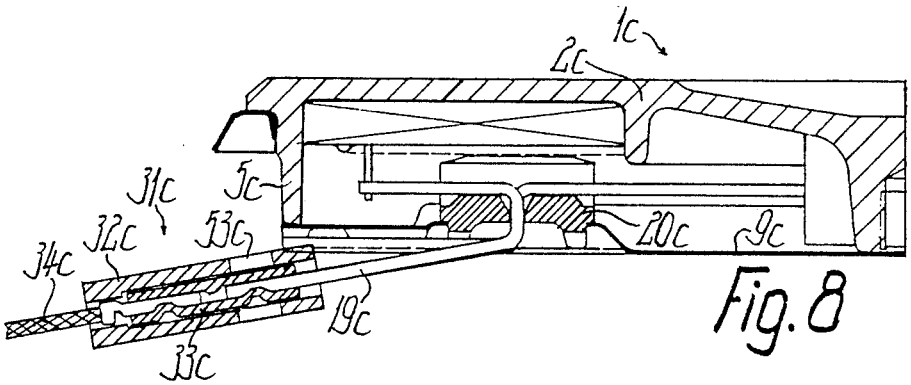
Fig. 8

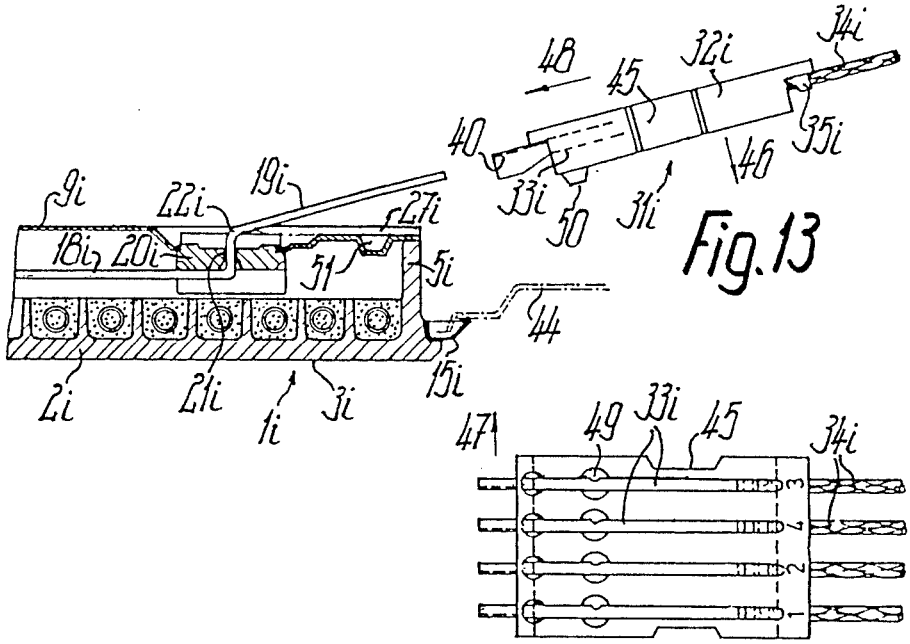
Fig. 13
Fig. 14
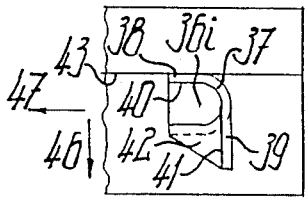
Fig. 15
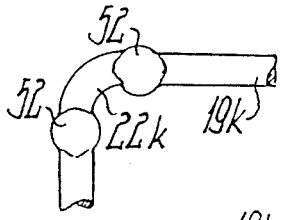
Fig. 16
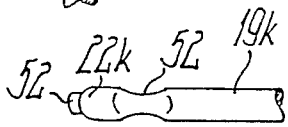
Fig. 17

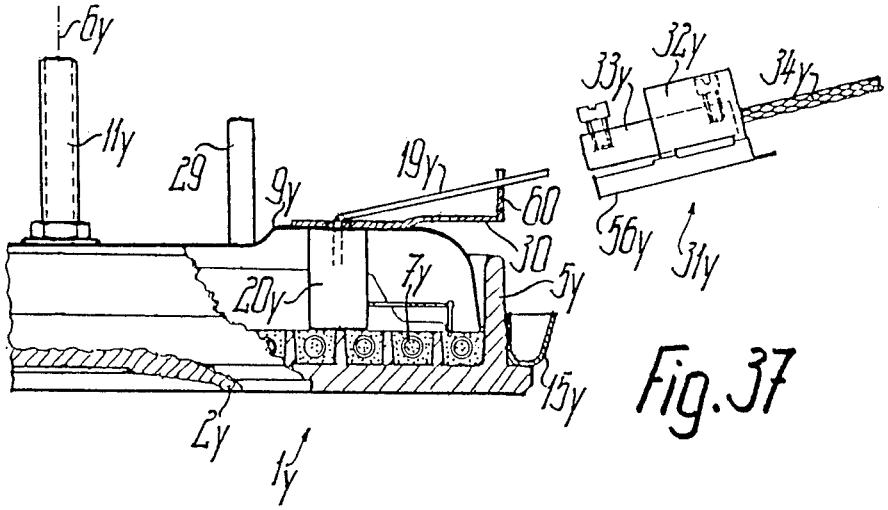
Fig. 37
Fig. 38
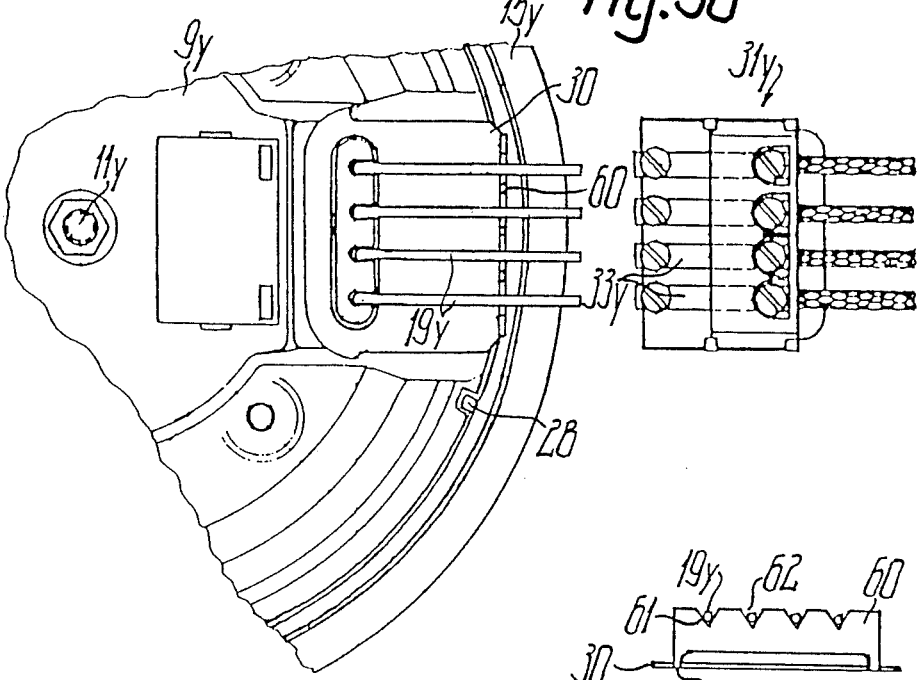
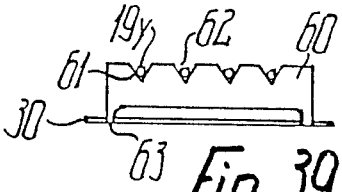
Fig. 39

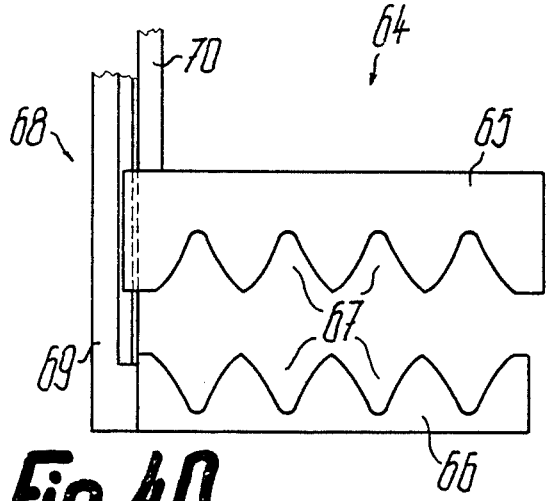
Fig. 40
Fig. 41
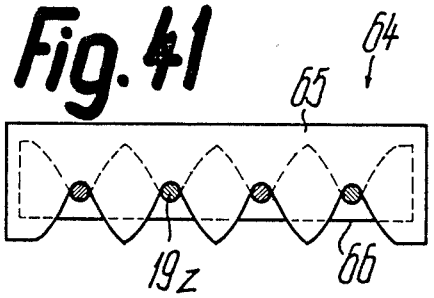
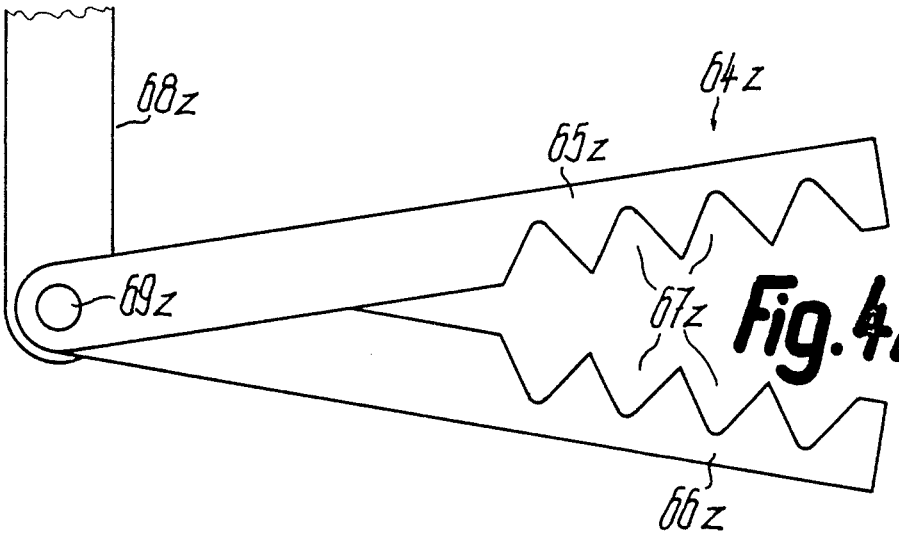
Fig. 42

ELECTRIC HOTPLATE AND APPARATUS FOR THE CONNECTION THEREOF

BACKGROUND OF THE INVENTION

The present invention relates to an electric hotplate with a hotplate body and a lower cover with an insulating member for the passage of heating resistor leads, whose outer connection portions have their ends constructed for the connection of implement or appliance lines and are fixed in a transportation and fitting position.

In the case of electric hotplates there is a need for compact stacking for storage and transportation, but at the same time the hotplate must be easily fixable, in a substantially automated manner, to a hob and also securely connectable to the appliance lines. The electric hotplate is inserted in a fitting or assembly opening of the hob, it is braced with respect to the edge of said assembly opening against bearing loads and connected to the appliance lines on the underside of the hob. The assembly opening is usually only slightly wider than the greatest width of the hotplate body part engaging therein and which is provided in the vicinity of an outer, annular cast iron flange edge of the hotplate body. It is important for the stacking of the hotplate especially for automatic stacking, that the underside of the latter is suitable for stacking purposes and this generally leads to the connecting portions for connecting the appliance lines being relatively inaccessible.

SUMMARY OF THE INVENTION

An object of the present invention is to provide an electric hotplate of the described type, which in the case of a simple construction ensures automatic handling, particularly with respect to stacking.

According to the invention this object is achieved in that the outer portions of the leads in the transportation and assembly position extend from above at the most roughly to the underside of the hotplate. Therefore the hotplate is suitable for superimposed stacking with similar or identical hotplates, e.g. accompanied by the interposing of a cardboard or similar flat body coated with a foam sheet, in such a way that superimposed hotplates are reciprocally coaxially arranged. The hotplates can be supported on one another alternatively by their cooking faces and their undersides or in a particularly advantageous manner can be stacked with the same orientation so that in each case adjacent hotplates face one another with a cooking surface and an underside, the bottom hotplate being appropriately arranged with downwardly facing cooking surface.

It is important for the fitting of the hotplate, which appropriately takes place in an inverted or upside down manner, i.e. with the hotplate pointing downwards and the hob directed upwards, how that part of the hotplate which must be introduced through the fitting opening into the hob is constructed. If said part has members, particularly connecting portions or flexible leads projecting beyond the outer circumference of the hotplate, then a tilting of the hotplate with respect to the hob may be necessary for fitting purposes, which can make fitting more difficult, particularly if fitting or assembly is automated. However, if the connecting portions are only constructed as short stubs projecting above the insulating member, then although insertion of the hotplate into the hob is easy, access for connecting the appliance lines can be relatively complicated and may require a connection exclusively by a welded joint. According to the invention fitting is greatly simplified in that in the transportation and assembly position the connecting portions of the leads at the most extend up to the outer circumference of the hotplate body and in particular at the most to the inner circumference of an outer flange edge of the hotplate body.

According to a particularly advantageous further development of the invention, the connecting portions can be transferred out of the transportation and fitting position following the insertion of the hotplate into the hob into a connecting position in which they project beyond the outer circumference and/or beyond the underside of the hotplate and are consequently very easily accessible for connection purposes. In this connecting position, the connecting portions appropriately form inherently rigid, but resiliently movable and substantially straight plug-in or connecting pins directed approximately parallel to the outside of the hotplate and which are preferably constructed in one piece at least from the joint or the passage through the insulating member and can project relatively far beyond the outer circumference of the hotplate. The inflexible connecting portions which can only be deformed by applying relatively high bending or kinking forces can be connected to the appliance lines in their connection position from the outer circumference of the hotplate, e.g. in a plug-in or plugging movement, the resilient mobility thereof compensating any slight positional variations with respect to the connecting members. Particularly if the transportation and fitting position of the connecting portions is the same as their connecting position, it is appropriate to provide a more particularly slot-like reception depression in the underside of the outer flange edge and/or the cover for that part of the connecting portion located between the insulating member and the outer circumference of the hotplate body, so that although the connecting portion can project beyond the outer circumference of the hotplate, it does not project beyond the underside of the hotplate and therefore in no way impedes stacking. From the position engaging in the reception depression, the connecting portion can be bent away from the underside of the hotplate into a sloping position or into a position at right angles to the underside of the hotplate and can thus be transferred into a preferred connecting position. The connecting portions can be arranged in such a way that under stacking pressure they spring back into the reception depression and when freed from the stacking pressure project resiliently beyond the underside of the hotplate. The inventive construction advantageously takes account of the disadvantages resulting from the fact that when operating the hotplate relatively high temperatures occur in the immediate vicinity of its underside or bottom surface, which can impair or damage both the connections and also the appliance lines. The temperature decreases considerably even at relatively small distances from the underside of the hotplate, so that the inventive construction displaces the connections and appliance leads into an area where excessive temperatures do not occur. The leads are constructed over their entire length in such a way that they are resistant to high temperatures.

The objects of the invention can advantageously be achieved in that a common connecting piece is provided for all the connecting portions which common connecting piece is provided with separate connecting members juxtaposed on an insulator and is provided with threading guidance means for the connecting pins in the vicinity of the front ends thereof, so that also in the case of automated fitting it is possible to simply ensure a positionally correct connection between the connecting portions and connecting piece or the appliance lines connected thereto. Thus, the connecting piece contributes to the positionally correct orientation of the connecting portions prior to the final connection or prior to reaching its final position. For this purpose control or guide surfaces can be provided on the insulator and on the connecting members or on both of these parts and said surfaces are appropriately arranged in such a way that they have an aligning action in at least two coordinate directions.

According to a further development of the invention, with respect to the connecting members, the connecting piece has insulated joining or orienting members for direct engagement in the hotplate, so that it is possible to attain in a simple manner a precise position orientation and optionally a directly supporting connection of the connecting piece with respect to the hotplate. In its connecting position appropriately a large part of the complete length of the insulator projects over the outer circumference of the hotplate, so that the appliance lines connected to its outer end are a relatively long way from the hotplate and consequently need not be constructed in a temperature-resistant manner.

Prior to fitting, the connecting portions can also be aligned in a positionally correct manner with respect to the hotplate by a separate centering member, which engages on the connecting portions at a distance from the passage through the insulator and appropriately allows the ends thereof to project freely at least over a short length. The centering member, which can be transferred from a stacking position into a fitting position, is advantageously arranged in such a way that, on connecting the connecting piece, it gradually frees the connecting portions over the entire length thereof engaging in the connecting piece.

The mechanical and safe electrically conducting connection between the connecting members and the connecting portions can be brought about by resistance welding, spot welding, shielded arc welding and in particular by non-contact welding, such as laser welding. However, it can also be brought about by crushing the connecting member, by clamping screws or by optionally redetachable detachable plug connections, which is particularly advantageous if hotplates have to be interchanged or replaced. In the same way the said connections are also suitable for connecting the connecting members to the appliance lines and for adapting to the particular requirements any possible combination between the indicated connection methods and the appliance lines is conceivable.

The risk of the heating resistor connecting leads being torn away from their connection with the heating resistors during stacking of the hotplate or during fitting as a result of a movement of the connecting portions within the hotplate, can be greatly reduced in that the inner portions of the leads are so secured with respect to the hotplate that movements of the connecting portions cannot be transferred thereto.

The inventive hotplate is particularly suitable for automatic stacking and automatic fitting with the aid of robots. Appropriately both the hotplate and the connecting piece or its insulator is provided with at least one positioning member, by means of which the position of the hotplate or connecting piece can be accurately recognized by the robot and said position can be secured.

An apparatus for fitting the connecting piece to the electric hotplate is, according to the invention, characterized in that a gripper is provided, which moves the connecting piece in three coordinate directions with respect to the connecting portions, in order to successively engage these with the guide surfaces, so that in a simple manner there is a precise orientation of the connecting portions with respect to the connecting piece. In addition thereto or in place thereof, it can also be advantageous to provide a gripping and aligning device for the connecting portions and there are preferably two clamping or gripping jaws, whereof at least one has a comb-like gripping face with centering cutouts for the connecting portions. The centering cutouts can in simple manner be bounded in prismatic, e.g. V-shaped manner.

These and further features of the preferred further developments of the invention can be gathered from the description and drawings and the individual features can be realized singly or in the form of sub-combinations in an embodiment of the invention and in other fields.

BRIEF DESCRIPTION OF THE DRAWINGS

The invention is described in greater detail hereinafter relative to non-limitative embodiments and the attached drawings, wherein.

FIG. 4 is another embodiment of an electric hotplate in axial section.

FIG. 5 is the arrangement according to FIG. 4 in a view from below.

FIGS. 8 to 11 are four further embodiments in representations corresponding to FIG. 6.

FIG. 13 is a hotplate in the fitting and connecting position with associated connecting piece.

FIG. 14 is the connecting piece according to FIG. 13 in a view from above.

FIG. 15 is a detail of the connecting piece in a view of the connecting end according to FIG. 13.

FIG. 16 is a detail of a lead on a larger scale and in side view.

FIG. 17 is the detail according to FIG. 16 in plan view.

FIG. 37 is another embodiment of a hotplate with associated connecting piece in a representation corresponding to FIG. 13.

FIG. 38 The arrangement according to FIG. 37 in a view of the underside of the hotplate.

FIG. 39 is a detail of FIG. 37 in a longitudinal view of the connecting portions.

FIG. 40 is a tool according to the invention for positioning the connecting portions of the electric hotplate during the connection of these connecting portions with the connecting members respective the connecting piece shown in a front view and an opened condition.

FIG. 41 is the tool according to FIG. 40 in closed condition.

FIG. 42 is a further embodiment of a tool shown in a view according to FIG. 40.

DETAILED DESCRIPTION OF THE PREFERRED EMBODIMENTS

Figures 1, 2, 3:
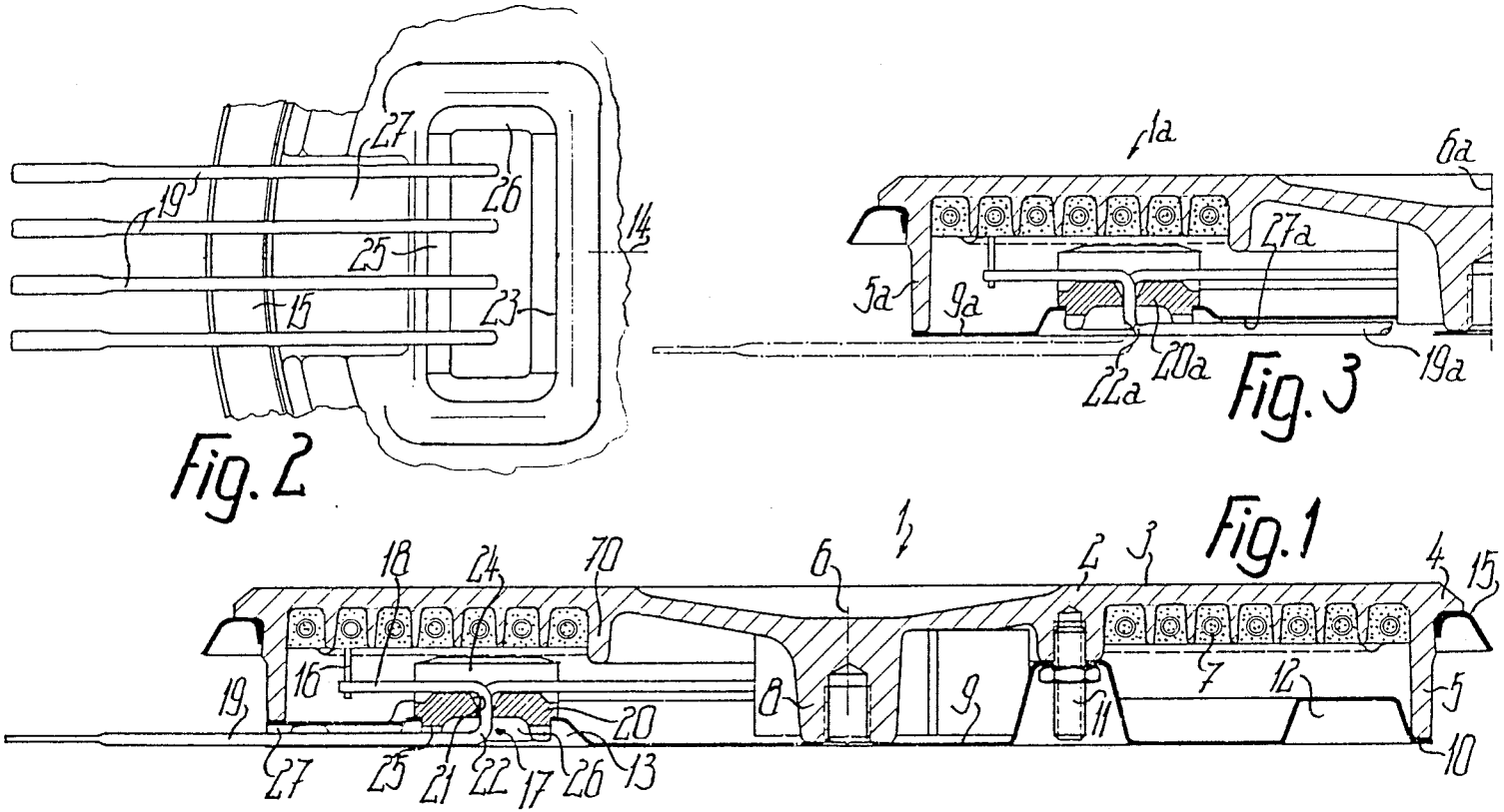
FIG. 1 is an inventive electric hotplate in cross-section.
FIG. 2 is a detail of the hotplate of FIG. 1 in a view from below.
FIG. 3 is another embodiment in axial section.

The electric hotplate 1 according to FIGS. 1 and 2 has a one-part, cast iron hotplate body 2, whose top surface forms a planar cooking surface 3, which is centrally provided with a depression and is therefore annular, but free from openings. The e.g. circular hotplate body 2 forms a circumferential collar 4 connected to the cooking surface 3 and whose outer circumference determines the maximum width or diameter of the hotplate body 2 and to whose underside is connected a jacket-like or apron-like flange edge 5, which is slightly inwardly displaced with respect to said outer circumference and whose lower front face defines the underside of the hotplate body 2. This outer flange edge 5, which is axially symmetrical to the central axis 6 of electric hotplate 1, projects downwards farther than the part of the underside of the hotplate body 2 connected thereto towards the central axis 6. In said part are provided slots running spirally about the central axis 6 and which are separated from one another by correspondingly spiral, rib-like intermediate webs of the cast iron body and said slots contain one, two or more heating resistors 7 in the form of heating coils, which are embedded in contact-free manner with respect to hotplate body 2 in a mineral, compressed insulating material. In the radially inner region of the zone in which the heating resistors 7 are located, said zone is bounded by an inner flange edge 70 of the cast iron body corresponding to the outer flange edge 5, said flange edge 70 appropriately projecting less far downwards than the outer flange edge 5.

In the center, i.e. optionally with a radial spacing within the inner flange edge 70, the hotplate body 3 has a center stud 8, provided with a taphole, projecting roughly as far over its underside as the flange edge 5. The underside of electric hotplate 1 or the space surrounded by flange edge 5 is provided with a sheet metal cover 9, which engages under tension with an outer ring rim 10 on the lower front face of flange edge 5. The cover 9 formed by a lid-like deep-drawn or stamped part and whose outer circumference is formed by the edge face of the ring rim 10 having roughly the same width as the outer circumference of flange edge 5, is tensioned against the underside of the hotplate body 2 and therefore against the front faces of center stud 8 and flange edge 5 by at least one and in particular two or more screws 11 and nuts engaging in eye-shaped widened portions of flange edge 70 located outside central axis 6. The screws are so countersunk in recesses in the underside of cover 9, that the screws 11 do not project beyond the areas of the underside of cover 9 substantially located in one plane, namely that of ring rim 10. The taphole of center stud 8 is accessible through an opening in the cover and is used for fixing the hotplate in a hob. Apart from the aforementioned planar underside, cover 9 exclusively has areas forming recesses on the underside, i.e. which are set back upwards with respect to said underside. These areas are in particular formed by an approximately closed ring slot-like recess located immediately adjacent to ring rim 10 and an approximately rectangularly bounded recess 13 in a view from below, which is located in the vicinity of the interruption of ring slot 12 symmetrically to an axial plane 14 of the hotplate. On the underside of the circumferential collar 4 or the lower ring shoulder formed by it is provided a sheet metal bearing ring 15, which closely surrounds the outer circumference of flange edge 5 over a small part of its height and is used for supporting hotplate 1 on the edge of the fitting opening in a hob or the like. Bearing ring 15 can be approximately U-shaped in cross-section, its outer ring leg appropriately in cross-section slopes outwards the bottom.

Heating resistors 7 have end pins 16 fixed to their ends which project downwards from the insulating bed and are completely located in the space between the underside of hotplate body 3 and cover 9. To said end pins 16 are fixed the ends of the inner portions 18 of heating resistor leads 17, whereby said inner portions 18, between insulating member 20 and the in each case associated end pin 16, run substantially linearly or parallel to cooking surface 3 in spaced manner between the underside of the hotplate body and cover 9. All and in the represented embodiment four leads 17 are led out downwards from the hotplate or through cover 9 by juxtaposed passage openings 21 in insulating member 20 which are at right angles to cooking surface 3. On either side of axial plane 14, openings 21 are located in a common plane at right angles thereto and the insulating member 20 is approximately symmetrical to axial plane 14. Portions 18 are bent approximately at right angles immediately adjacent to the inside of insulating member 20 or the associated, conically widened end of the particular passage opening 21 and with said bent part can be located in substantially clearance-free at least in a narrow outer portion of the particular passage opening 21. Immediately adjacent to the outside of insulating member 20 or connected to the outer narrow end of passage opening 21, the particular lead 17 is again provided with a bend 22 in such a way that following on to said bend it forms an outer, linear connecting portion 19, which is parallel to axial plane 14 and is directed against the area of flange edge 5 closest to insulating member 20. Thus, in the vicinity of the passage through insulating member 20, leads 17 are in part bent approximately U-shaped and in part Z-shaped. From the direct connection with the heating resistors or their end pins up to the ends of the connecting pins, the leads are formed from one-part, bent, heat-resistant solid wire portions, which are particularly made from a chromium-nickel alloy and which are preferably bent directly on the underside of the insulating member. The appropriately steatite insulating member 20 passes through a window-shaped opening 23 closely surrounding same with its boundary in the underside-parallel bottom of recess 13 of cover 9 and is supported by a shoulder face on the inside of the edge of cover 9 surrounding opening 23. By means of projections 24 on either side of the passage openings 21 or the leads and projecting over the inside thereof, insulating member 20 is also supported on the underside of hotplate body 3 in the area in which the heating resistors 7 are located. The outer ends of the passage openings 21 are located in an area of insulating member 20, which is roughly in the plane of the bottom of recess 13 and is surrounded by an all-round, projecting edge 26, but which does not project to the underside of cover 9. In the longitudinal sides of said edge 26 are provided cutouts 25, the connecting portions 19 crossing the edge 26 at right angles in the vicinity of the associated cutout 25. Following on to recess 13, between the latter and ring rim 10 is provided a less deep reception depression 27 in the underside of cover 9, which extends over ring rim 10 in the vicinity of a corresponding cutout in flange edge 5 and in which the connecting portions 19 are located in such a way that they do not extend beyond the underside of cover 9 and their ends do not project beyond the outer circumference of flange edge 5. In the relaxed state, the connecting portions 19 are in a common plane at right angles to axial plane 14 or central axis 6 and said plane can also be inclined by a few radians with respect to the underside of cover 9 or cooking surface 3 that the connecting portions 19 at the free ends thereof move away from the underside and with said free ends are spaced from the underside of the remaining hotplate. All the the connecting portions 19 are of the same length or are sufficiently long that their free flat-pressed ends at right angles to the common plane are located in a common plane at right angles to axial plane 14.

On the underside of the hotplate, in the lower front face of flange edge 5 is provided a not further shown positioning member in the form of a cutout, in which engages a cam of cover 9 shaped out of the ring rim 10 thereof. Thus, the position of the cover with respect to the hotplate body 2 is precisely fixed and also this positioning member is appropriate for the positionly correct alignment of the hotplate with respect to central axis 6 during the fitting thereof.

In the embodiment according to FIG. 3 the bend of the particular lead 17 located directly on the underside of insulating member 20 is constructed as a desired bending point or articulation **22*a* through the associated wire being cross-sectionally weakened in this region by crimping or squeezing. The articulation axis is appropriately parallel to the underside of hotplate 1*a*, in such a way that the connecting portion 19*a* can be pivoted out of its transportation and fitting position shown in continuous line form in FIG. 3 by approximately 180° into the connecting position shown in dot-dash manner, in which it is in accordance with FIG. 1. In this case the reception depression 27*a* is provided in cover 9*a* in such a way that it receives the connecting portion 19*a* in its transportation and fitting position from insulating member 20 to the center of hotplate 1*a*, while the connecting portion 19*a* in the connection position is located below the underside of cover 9*a* or flange edge 5*a***.

Figure 6:
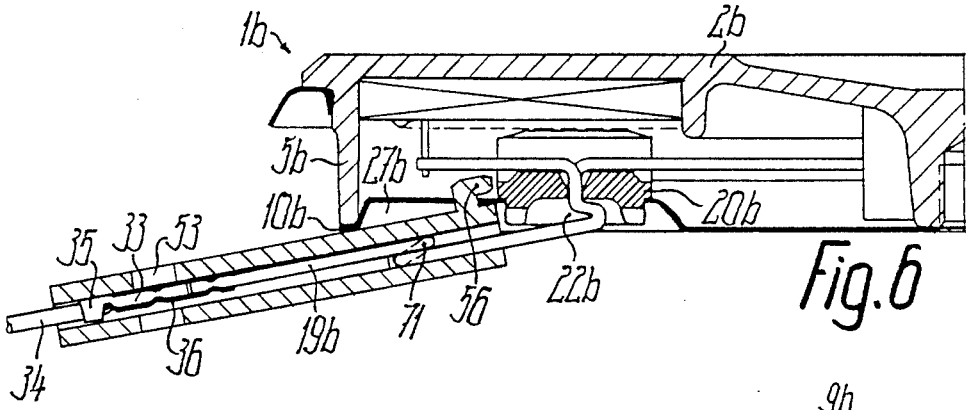
FIG. 6 is the hotplate according to FIG. 4, but in the connected state.
Figure 7:
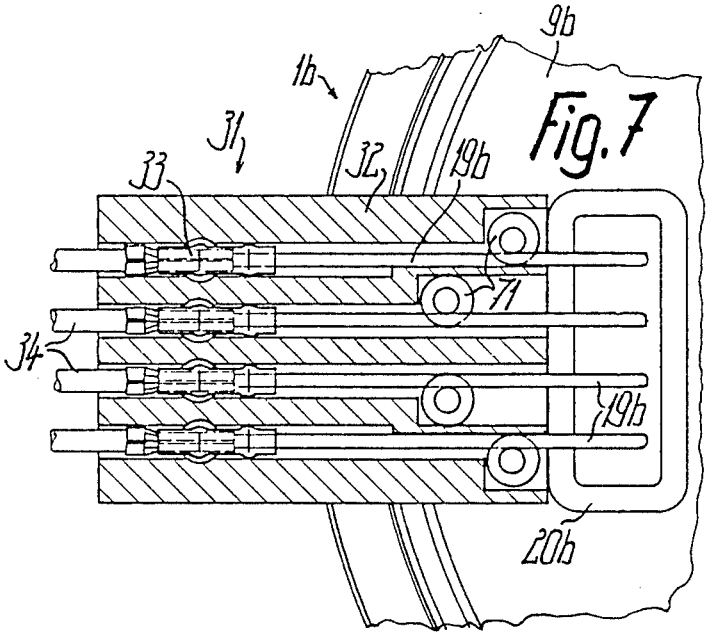
FIG. 7 is the arrangement according to FIG. 6 in a view from below.

In the embodiment according to FIGS. 5 to 7, the articulation of the particular connecting portion **19*b* is provided between its bend 22*b* or insulating member 20*b* and the closest area of flange edge 5*b* or ring rim 10*b* of cover 9*b* and is formed by a helical torsion spring 71, to which is bent in this area the connecting lead 17*b*, which is e.g. made from spring wire. In the extended position of connecting portion 9*b* with the spring 71 relaxed, the latter has a single spring turn of 360°, being connected tangentially to the linear, aligned parts of the connecting portion 9*b*, i.e. is located substantially laterally alongside the same on the side remote from axial plane 14*b*. On adjacent connecting portions 19*b* in the longitudinal direction thereof, springs 71 are reciprocally displaced and in pairs the two outer springs 71 are closer to insulating member 20*b* and the two central springs 71 are closer to flange edge 5*b*. Under pretensioning of the associated spring 71, the particular outer or free terminating part of connecting portion 19*b* serving as a connecting pin can be pivoted away about an axis at right angles to the underside or cooking surface 3*b* from axial plane 14*b* until its end rests on the inner face of a shoulder of cover 9*b* serving as a stop 72 and which forms a transition between ring rim 10*b* and the bottom of reception depression 27*b*. In said reception depression 27*b*, spring 71, including the connecting parts of connecting portions 19*b* have sufficient space that they do not project beyond the underside of cover 9*b* in the transportation and fitting position. Springs 71 are wound from the straight parts of the connecting portions 19*b* coming from insulating member 20*b* in the direction of the bottom of reception depression 27*b*, so that the free end parts of connecting portions 19*b* engage on said bottom in the transportation and fitting position. By slightly raising connecting portions 19*b* from cover 9*b*, their free end parts become free from stop 72, so that they spring into the extended connecting position shown in dot-dash manner in FIG. 5. In the embodiment according to FIG. 4, the bends 22*b* have two immediately adjacent bending points, namely an approximately right-angled bend directed towards the center of the hotplate and connected directly to the lower end of passage opening 21*b* and a hairpin-shaped, oppositely directed bend connected thereto, so that advantageously there is a tension relief for lead 17*b*. One leg of the hairpin-shaped bend passes linearly into the associated part of connecting portion 19*b*, said bend being at least partly countersunk in the underside of insulating member 20*b***.

As shown in FIGS. 6 and 7 for connecting all the connecting portions **19*b* a common connecting piece 31 is provided, which is provided in a steatite or similar insulator 32 with a plurality of parallel, directly juxtaposed and electrically conductive connecting members 33 corresponding to the number of connecting portions 19*b* and which extend over only part of the length of insulator 32 and are arranged in concealed manner completely within the same. Appliance lines 34 are connected to the rear ends of connecting members 33 by means of crimp or clamping connections 35, said appliance lines 34 possible being flexible, i.e. easily bendable or bending-slack lines optionally provided with a separate insulating jacket, such as copper-stranded wires and which in the vicinity of their transition into connecting piece 31 are aligned with the front ends of connecting members 33. The latter are constructed in the manner of guide pins in the vicinity of their front ends and which roughly have the same cross-section or diameter as the connecting portions 19*b*. The pins of connecting members 33 are interconnected in aligned manner with the connecting portions 19*b* by a crimp connector constructed as a butt connector in the form of a ferrule 36, which is appropriately fitted to the connecting portion 19*b* by crimping prior to joining to connecting member 33 or prior to insertion in insulator 32 and forms the part projecting as a socket above the same which engages on stop 72 in the transportation and fitting position. On connecting the connecting portions 19*b*, the latter are inserted in insulator 32, then the connecting members 33 of appliance lines 34 formed by multicore cable ends are inserted in ferrules 36 and then secured by joint crimping with ferrule 36. Two aligned engagement openings 53 are provided in the vicinity of each crimping point on either side of insulator 32 for the engagement of the crimping tool. Connecting members 33 are located in the vicinity of the end of insulator 32 remote from insulating member 20*b* in spaced manner outside the outer circumference of the hotplate in an area where there are only relatively low temperatures when the hotplate is operating. Within pocket-like-widened openings, springs 71 are located completely within insulator 32, which is in turn almost directly connected to insulating member 20*b* and is inclined downwards under a few radians at its outer end, in such a way that under the tension of the resiliently upwardly pressing connecting portions 19*b* it is supported on the underside of ring rim 10*b* or flange edge 5*b*. The extremely flat (in side view), almost plate-like insulator 32 is provided in the vicinity of its front end and on the top surface with at least one hook member 56, constructed in one piece therewith and which can be suspended in a corresponding opening in the bottom of reception depression 27*b* and therefore assists in the alignment of connecting piece 31 with respect to the hotplate both in the insertion depth direction and at right angles to the underside of the hotplate and in lateral directions. Thus, the associated end of connecting piece 31 engages in reception depression 27*b***.

Figure 9:
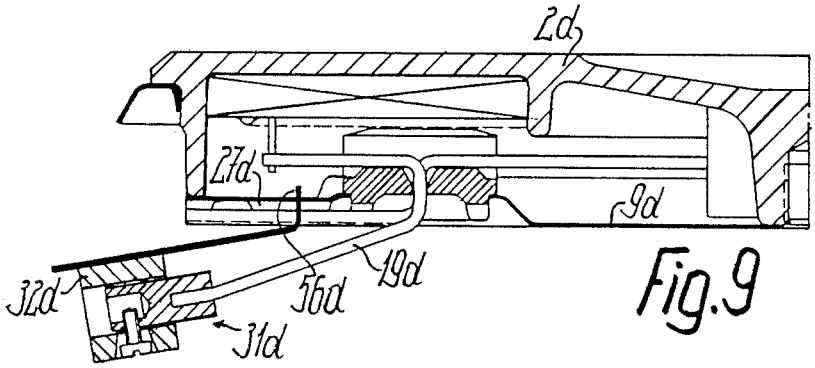

As shown in FIG. 8, connecting member **33*c* can also be directly formed by the ferrule, which is fixed to the associated end of the appliance line 34*c* before connection to the hotplate. In this case, the engagement openings 53*c* for the crimping tool are located in the regions of connecting piece 31*c* in which the connecting portions 19*c* are to be inserted. According to FIG. 8 connecting piece 31*c* or insulator 32*c* is spaced from insulating member 20*c*, the end thereof facing the latter being approximately located in the vicinity of the flange edge 5*c*. Whereas in the construction according to FIG. 8 there is no direct connection between insulator 32*c* and cover 9*c* and instead connecting piece 31*c* is freely carried by connecting portions 19*c*, in the embodiment according to FIG. 9 a plug-in profile 56*d* is provided, which is formed by the shorter leg of a bent sheet metal profile, which carries on its underside insulator 32*d* of connecting piece 31*d*. Plug-in profile 56*d* engages in a corresponding opening in the underside of cover 9*d*, particularly in the bottom of reception depression 27*d* and carries the actual connecting piece 31*d*, together with the connecting portions 19*d*. To its ends is in each case fixed one connecting bush, provided in the portion thereof located within insulator 32*d* with a connecting bore for inserting the appliance line and a clamping screw for the detachable clamping of the appliance line. In place of this, a corresponding plug connection is conceivable, which can be constructed detachably or in self-locking manner in such a way that after insertion it is no longer possible to detach the appliance line or connecting portion in destruction-free manner. Particularly in the case of the construction according to FIGS. 6 and 7 or according to FIG. 8**, the ferrules appropriately are made from a corrosion-resistant steel and can have relatively thick walls. They can also be constructed for an overlapping parallel connection.

Figure 10:
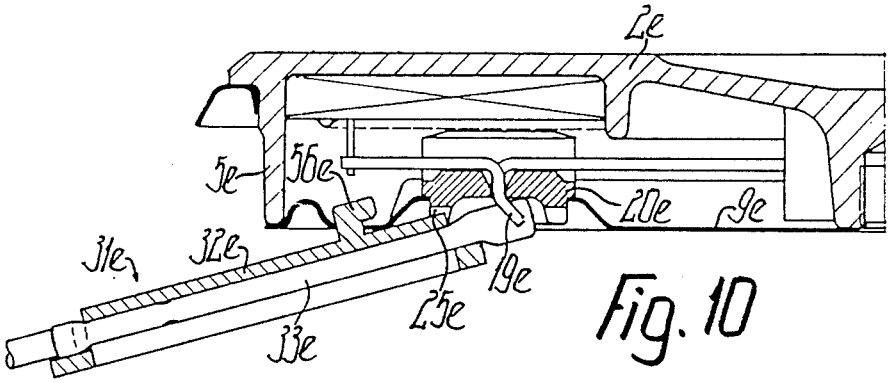
Figure 11:
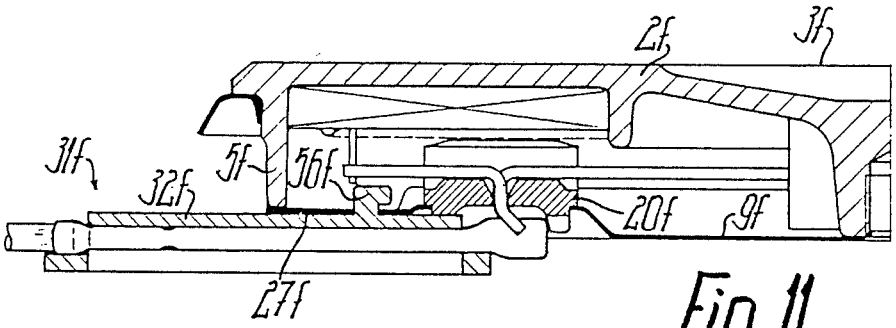

As shown in FIG. 10, it is also possible in certain cases to form the connecting portions **19*e* by short connecting stubs, which accompanied by slight bending on the lower ends of the passage openings project linearly in the direction towards the underside of the hotplate, but do not project beyond said underside and are instead countersunk in a depression on the underside of insulating member 20*e*. To the connecting portions 19*e* are fixed by welding or the like the connecting members 33*e*, which appropriately project over the associated end of insulator 32*e* of connecting piece 31*e* and pass in one piece substantially over the entire length thereof. Hook member 56*e* engages in cover 9*e* in such a way that the associated end of connecting piece 31*e* or insulator 32*e* is located in one cutout 25*e* on the underside of insulating member 20*e*, whilst insulator 32*e* is spaced below the same in the vicinity of flange edge 5*e*. In the embodiment according to FIG. 11, hook member 56*f* is such that the insulator 32*f* of connecting piece 31*f* is parallel to cooking surface 3*f* and engages both in the cutout of insulating member 20*f* and in the reception depression 27*f* of cover 9*f* and flange edge 5*f***.

Figure 12:
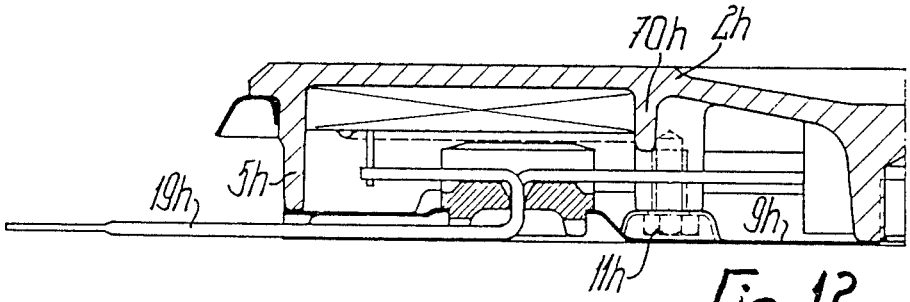
FIG. 12 is another embodiment in a representation corresponding to FIG. 3.

Whereas in the embodiment according to FIG. 1, screw 11 is formed by a stud bolt, whose threaded portion is freely located in the associated recess of cover 9 and can optionally be used for preventing the hotplate turning with respect to the hub, the arrangement according to FIG. 12 is such that the depression in cover **9*h* belonging to the corresponding screw is relatively shallow, namely its bottom wall engaging on the front face of the eye-shaped widened portion is located roughly in the plane of the end face of flange edge 5*h* and not in the plane of the end face of flange edge 70*h*. The depression is adequate for receiving the head of a cap screw 11*h* or a nut locking a stud bolt in accordance with the construction of FIG. 1**.

In the drawings the corresponding parts carry the same reference numerals, but the letters following them differ according to the individual embodiments.

In the embodiment according to FIGS. 13 to 15 a connecting piece **31*i* is provided, whose connecting members 33*i* extend over the entire length of insulator 32*i* and project freely over its front end. In the area behind the front, freely projecting ends, the connecting members 33*i* are constructed in the manner of connector sockets and in this area approximately up to the connection of the appliance lines 34*i* they are U-shaped in cross-section and the opening between the U-legs is covered by an inner face of the reception opening in insulator 32*i*, so that a cross-sectionally circumferentially closed socket opening 36*i* partly bounded by connecting member 33*i* and partly by insulator 32*i* is formed and its width is less than twice as large as the diameter of connecting portions 19*i*. The freely projecting front ends of the connecting members 33*i*, constructed in the manner of multicore cable ends, form threading guidance means and for this purpose have a cross-sectional shape which is not completely closed over the circumference. In the represented embodiment, this cross-sectional shape is approximately rectangular with a rounded transition zone between the angle legs, whose radius of curvature corresponds to that of the semicircular cross-web of the U-profile and is aligned therewith. A shorter angle leg 38 of said angle profile 37 in the connected position is parallel to the central plane of connecting pins 19***i* and namely on the side thereof remote from cover 9*i* and is aligned with the associated U-leg of connecting member 33*i* of which it forms a continous extension. The other, longer angle leg 39 is at right angles thereto and is directed counter to the underside of cover 9*i*. Angle leg 39 is formed by a correspondingly shaped end portion of the other U-profile leg of connecting member 33*i* and passes into said profile leg by means of a smooth-surface, continuously curved guide portion 42 on the inside. The inner faces of angle legs 38, 39 form two guide surfaces 40, 41 at right angles to one another and passing into one another via a concave rounded portion, guide surface 41 continuously passing in curved manner into the inner face of guide portion 42 and therefore in the same way as guide surface 40 passes continuously into the associated inner faces of the socket opening 36*i*. By its outer face, angle leg 38 is connected to a shoulder surface 43 of insulator 32*i* covering the freely projecting ends of connecting members 33*i* or angle profiles 37 over part of the length thereof and which is formed by a corresponding projection passing over the width of insulator 32*i*. This projection or shoulder surface 43 is located on the side of connecting members 33*i* or angle profiles 37 remote from cover 9*i* and shoulder surface 43 can form an extension of guide surfaces 40. Angle legs 38 or guide surfaces 40 of all the connecting members 33*i* cross-sectionally project in the same direction, i.e. the threading guide members for all the connecting members have the same orientation. FIG. 13 shows the electric hotplate 1*i* in its preferred fitting position, namely with the cooking surface 3*i* at the bottom and with the hob 44 engaging in dot-dash manner in the bearing ring 15*i*. After joining together the hotplate 1*i* and hob 44, connecting piece 31*i* is moved in parallel or aligned manner to connecting portions 19*i* towards the latter by a not shown gripper. The gripper engages in two positioning members 45 of connecting piece 31*i* provided laterally on insulator 32*i* and which are formed by lateral cutouts or depressions, so that in addition to a positionally correct mounting of connecting piece 31*i* a positive connection in the plugging direction is also ensured. Connecting piece 31*i* is moved up to connecting portions 19*i* in such a way that the latter still have a certain spacing with respect to the extensions of the guide surfaces 40, 41 in the plugging direction, i.e. in all cases are located in the angular or plugging space enclosed by the same. As soon as the guide surfaces 40, 41 have overlapped all the connecting portions 19*i* by a sufficiently large length, the connecting piece 31*i* is moved in two coordinate directions 46, 47 at right angles to one another and to the plugging direction indicated by arrow 48, said coordinate directions being parallel or at right angles to the planes of guide faces 40, 41 and are in each case directed in the direction at right angles to the associated guide face 40, 41 in which said guide face points. Appropriately connecting piece 31*i* is initially moved in the coordinate direction 47 at right angles to guide face 41 until connecting portions 19*i* strike against the associated guide face 41, after which the connecting piece 31*i* is moved in the coordinate direction 46 at right angles to guide face 40 until the connecting portions 19*i* also strike against said guide face 40. Thus, connecting portions 19*i* are precisely aligned with respect to the socket openings 46, so that the connecting piece 31*i* can be mounted in the plugging direction of arrow 48 on connecting portions 19*i* constructed as pins, e.g. until the front ends of connecting members 33*i* or angle profiles 37 are located in the vicinity of bends 22*i*. During the movement in coordinate directions 46, 47, the movement in the direction of arrow 48 can be interrupted or it can be continued at such a low speed that in all cases the threading of the connecting portions 19*i* into socket openings 36*i* is ensured. Connecting portions 19*i* are then firmly connected to connecting members 33*i* within the latter, i.e. between their front and rear ends or between the front and rear end of insulator 32*i*. Advantageously this can e.g. take place by contact-free welding and for this purpose an access opening 49 is provided in the vicinity of each connecting member 33*i* on the side of insulator 32*i* remote from cover 9*i*. However, it is also possible to firmly connect the connecting members 33*i* to the connecting portions 19*i* in the vicinity of their freely projecting ends by welding, e.g. resistance welding.

Connecting piece 31*i* or insulator 32*i* is constructed as a flat body with an approximately constant thickness considered in the plugging direction or in side view and in plan view is elongated -rectangular with juxtaposed connecting members 33*i* over its width. At its side facing cover 9*i*, insulator 32*i* is provided with stud-like locking members 50 adjacent to its front end and with which are associated corresponding locking openings or depressions 51 in the bottom of reception depression 27*i*. In a view of the underside of the hotplate, the two locking depressions 51 are located on either side of the group of connecting portions 19*i*. On mounting the connecting piece 31*i* on connecting portions 19*i*, locking members 50 snap in the manner of stops into the locking depressions 51, so that the insertion depth with which the portions 19*i* engage in connecting piece 31*i* is precisely defined. The construction can be such that the locking members 50 are pressed into the locking depressions 51 by the spring tension of connecting portions 19*i* and are thereby secured in their locking position. In the connected state, the connecting piece 31*i* sloping to the underside of hotplate 1*i* corresponding to the connecting portions 19*i* projects relatively far over the outer circumference of flange edge 5*i* or hotplate body 2*i*, so that the appliance lines 34*i* are at a relatively large distance from the electric hotplate.

Bend 22, 22*a*, 22*b* etc. of each connecting portion also forms an articulation zone in the form of a desired bending point, through which the connecting portion can be pivoted particularly about a central axis at right angles to axial plane 14 with respect to the remaining hotplate and preferably at least up to a position projecting at right angles over its underside. Thus, after assembly, the connecting piece can optionally also be positioned vertically below insulating member 20*i*, the connecting portions appropriately only being bent after the joining to the connecting piece. According to FIGS. 16 and 17, said articulation zone 22*k* of lead 17*k* is formed by two cross-sectionally weakened portions 52 on either side of the bend, whereby said portions can be formed by crushing the solid wire piece and have their smaller cross-sectional extension at right angles to the articulation axis. The cross-sectionally weakened portions, which have a stiffening action in the manner of flat profiles, can also be provided in juxtaposed manner immediately adjacent to the bend on the associated end of the connecting portion, so that the bend and articulation zone are juxtaposed and do not coincide.

Figure 19:
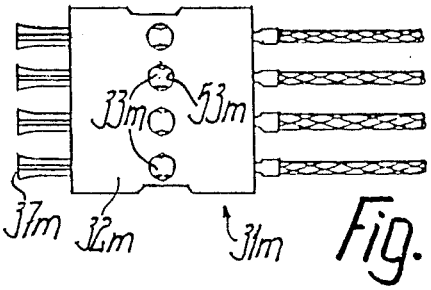
FIGS. 18 and 19 are a further embodiment of a connecting piece in representations corresponding to FIGS. 13 and 14.
Figure 18:
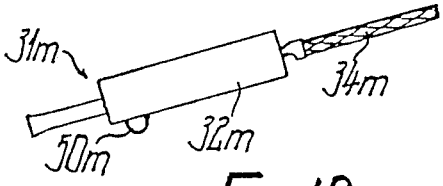

In the case of connecting piece 31*m* according to FIGS. 18 and 19, the connecting members 33*m* are formed by connector sockets projecting freely over the front end of insulator 32*m*, which are bent from sheet metal strips and are therefore longitudinally slotted. At a distance upstream of the front end of insulator 32*m*, connecting members 33*m* have conical extensions 37*m* as threading and guidance means for the connecting portions. On its associated side, insulator 32*m* also has a stop 50*m*, which can strike against the outer circumference of the flange edge of the hotplate body and consequently fixes the insertion depth for the connecting portion. The projecting connecting members 33*b* are particularly suitable for connection to the connecting portions by spot or non-contact welding, such as laser welding. Between its front and rear ends, insulator 32*m* is provided in the vicinity of each connecting member 33*m* passing through it with an engagement opening 53*m* for a crimping tool, by means of which the connecting members 33*m* are so shaped by crimping within the insulator 32*m* that they are positionally secured longitudinally with respect to said insulator. The engagement openings 53*m* can be provided in juxtaposed manner on the side remote from the hotplate, on the side facing the same, or on both sides, preferably in each case aligned with one another.

Figure 21:
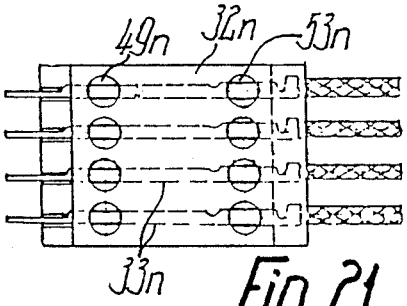
FIG. 21 is the connecting piece according to FIG. 20 in a representation corresponding to FIG. 14.
Figure 20:
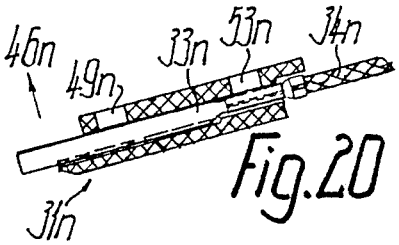
FIG. 20 is another embodiment of a connecting piece in a sectional side view.
Figure 22:
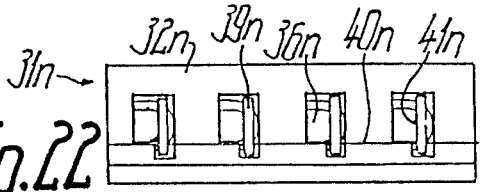
FIG. 22 is the connecting piece according to FIG. 20 in a view on the connecting end.

In the embodiment according to FIGS. 20 to 22 one guide surface 40*n*, namely the guide surface parallel to the common median plane of the connecting portions, is formed by insulator 32*n* and namely by a shoulder surface, similar to shoulder surface 43 according to FIG. 15 and which passes approximately over the entire width thereof. This shoulder surface is interrupted by flat strip-like or lug-like extensions of connecting members 33*n*, which engage in slot-like depressions in the shoulder surface in such a way that the guide surfaces 40*n* are approximately aligned with the associated inner boundaries of the socket openings 36*n*, said inner boundaries being formed by the associated U-profile legs of connecting members 33*n*. However, it is also possible to construct the connecting members 33*n* as planar strip-like connecting lugs over the entire length to be engaged with the connecting pins, e.g. up to the connection of the appliance lines 34*n*, so that the socket opening is only bounded on one side by the electrically conductive connecting member 33*n*, otherwise being bounded by insulator 31*n*. Each guide surface 40*n* passes in uninterrupted manner between two guide and connecting lugs 39*n*, each lug forming a guide surface 41*n* at right angles to guide surface 40*n*. In the represented embodiment, guide surfaces 40*n*, unlike in the embodiment according to FIGS. 13 to 15, are directed away from the underside of the hotplate, so that the associated coordinate direction 46*n* is also in the opposite sense. Apart from the access openings 49*n* for the non-contact welding located adjacent to the front end of insulator 32*n*, the latter also has for each connecting member 33*n* at least one engagement opening 53*n* for a crimping tool or the like. The freely projecting ends of lugs 39*n* are suitable for joining to the connecting portions by resistance welding or the like.

Figure 23:
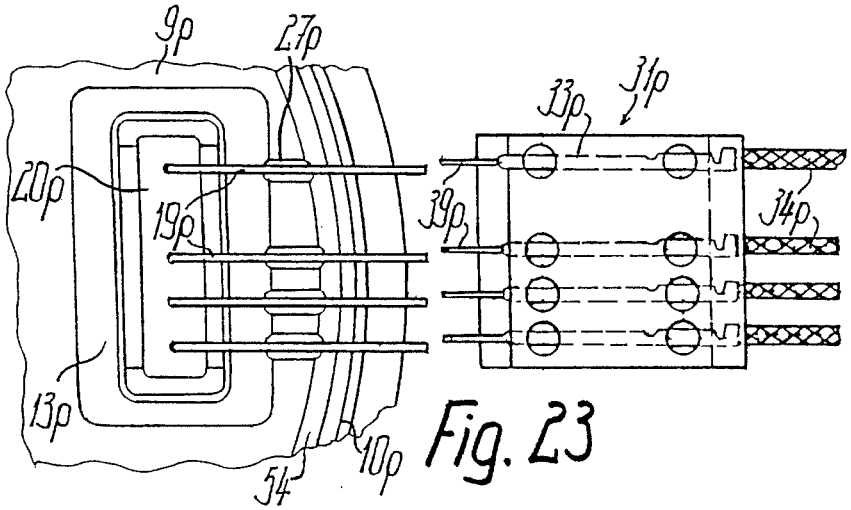
FIG. 23 is another embodiment of a hotplate with the associated connecting piece in a view of the underside.

Whereas in the embodiments according to FIGS. 1 to 22, the distances between adjacent connecting portions or members are identical, in the embodiment according to FIG. 23 they are so asymmetrically unequal that connecting piece 31*p* can only be connected thereto in a single predetermined position and consequently connection errors by reversed mounting of connecting piece 31*p* are made impossible. In a preferred embodiment except for one distance, more particularly located between two outer connecting members 33*p*, all the remaining distances between adjacent connecting members 33*p* are identical and the diverging distance is larger than the latter. A separate, slot-like reception depression 27*p* is provided in the underside of cover 9*p* for each connecting portion 19*p* and said depression is provided in cover 9*p* between a relatively narrow circumferential groove 54 connected to ring rim 10*p* and the recess 13*p* for insulating member 20*p*. Thus, each connecting portion 19*p* is secured against lateral movement and therefore possible bending during transportation or stacked storage.

Figure 25:
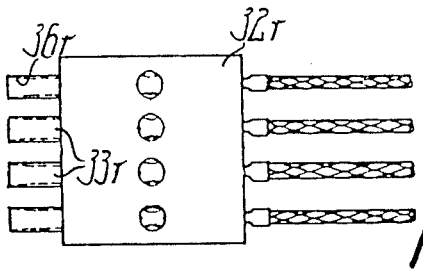
FIGS. 24 and 25 are a further embodiment of a connecting piece in representations corresponding to FIGS. 13 and 14.
Figure 24:
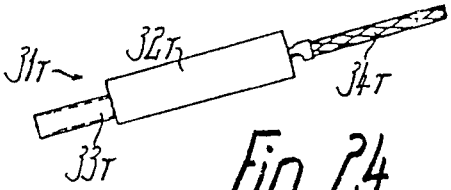

Connecting members 33*r* of connecting piece 31*r* according to FIGS. 24 and 25 form circumferentially closed, sleeve-like sockets 36*r* projecting freely over the front end of insulator 32*r* and whose inner bore is conically widened in funnel-shaped or acute-angled manner at the front end. The connecting members 33*r* are appropriately formed from thick-walled tubular sections made from corrosion-resistant steel or some other high temperature-resistant, electrically conductive material and can be mechanically secured by squeezing together with the connecting pins.

Figure 27:
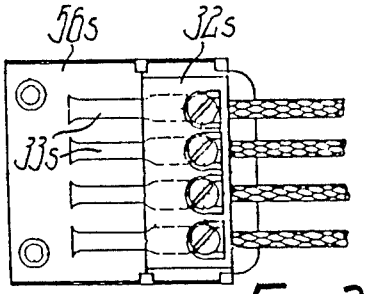
FIGS. 26 to 28 are another embodiment of a connecting piece in representations corresponding to FIGS. 20 to 22.
Figure 26:
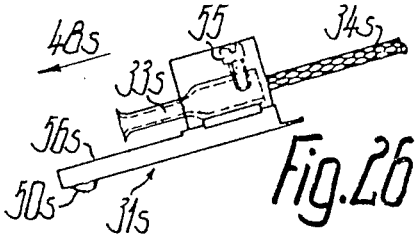
Figure 28:
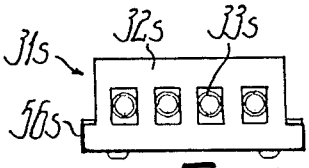

Also in the case of the embodiment according to FIGS. 26 to 28, the connecting members 33*s* are formed by relatively thick-walled steel sleeves widened in funnel-shaped manner by non-cutting shaping at their front ends for forming threading and guiding means for the connecting pins. The rear ends thereof located in insulator 32*s* are widened in oval or oval elliptical manner, so that their greater cross-sectional extension is at right angles to the common median plane of connecting members 33*i* or the connecting portions. In said portions threaded clamping screws 55 are guided in such a way that they engage in accordance with FIG. 31 in the lateral flanks of the oval cross-section of the connecting members 33*s* and are consequently particularly reliably guided. Clamping screws 55 are used for connecting the appliance lines 34*s*, which are consequently detachably fixed. The connecting members 33*s* are connected to the connecting portions by squeezing or crimping. Insulator 32*s* is fixed to a substantially U-shaped connector 56, which is bent from sheet metal and which can e.g. be constructed for mounting on a mating connector on the cover. Connector 56*s*, which partially engages round the insulator 32*s* for fixing in position, projects in the plugging direction of arrow 48*s* over the connecting members 33*s* and can in the vicinity of the front end thereof be provided with locking members 58*s* in the form of stampings. Connector 56*s* is located on the side of insulator 32*s* facing the hotplate and which it covers with respect to the latter.

Figure 30:
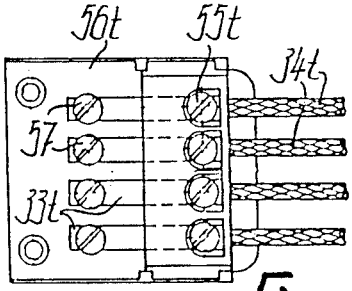
FIGS. 29 to 31 are another embodiment of a connecting piece in representations corresponding to FIGS. 13 to 15.
Figure 29:
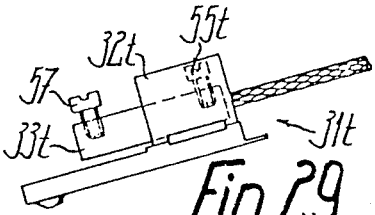
Figure 31:
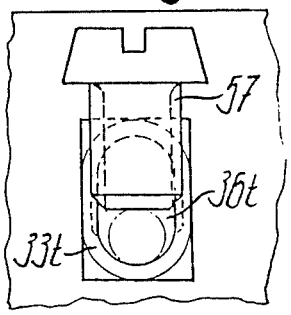

In the embodiment according to FIGS. 29 to 31, the connecting members 33*t* are cross-sectionally oval or oval elliptical over their entire length, so that the connecting portions can also be inserted in the oval elliptical socket openings, whose greater cross-sectional extension is at right angles to the common median plane of the connecting portions. Clamping screws 57 are also provided for locking the connecting portions and are so fitted in overhung manner on the projecting ends of connecting members 33t upstream of insulator 32t, that their threads engage in the parallel, planar, inner flank faces of the socket openings.

Figure 33:
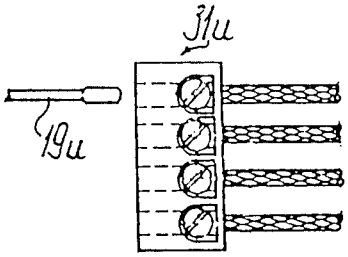
FIGS. 32 to 35 are two further embodiments of connecting pieces in representations corresponding to FIGS. 13 and 14.
Figure 32:
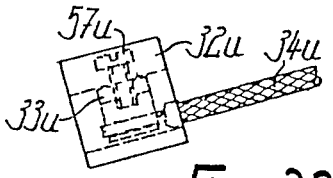

In the embodiment according to FIGS. 32 and 33, it is a question of a very short connecting piece 31u, whose insulator receiving the connecting members in fully countersunk manner has a much greater width than its extension in the plugging direction and can be constructed in the manner of a porcelain insulator. Appropriately there is only a single clamping screw 37u on each connecting member 33u, which in overlapping manner secures the end of the associated connecting portion 19u widened appropriately by crimping, against the associated end of the appliance line 34u and consequently directly against the latter. This end of appliance line 34u can be fixed by welding or the like to the connecting member 33u, or it can be simultaneously detachably secured to the connecting portion 19u by clamping spring 57u. Clamping screws 57u are also arranged in countersunk manner in insulator 32u. This construction is particularly suitable for transferring the connecting portions 19u into a position projecting approximately at right angles from the underside of the hotplate, so that connecting piece 31u and appliance line 34u are located a relatively long way below the electric hotplate, if this is permitted by the space available beneath the hob.

Figure 35:
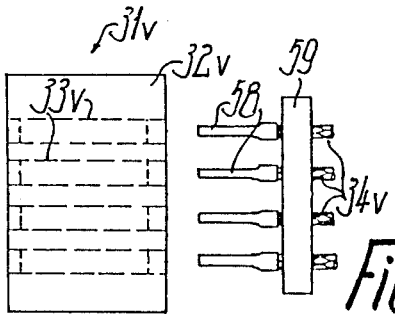
Figure 34:
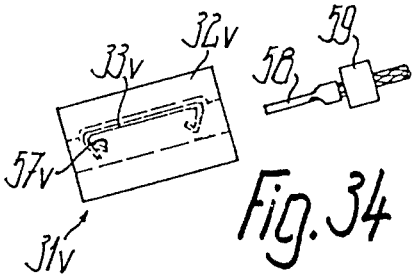

As shown in FIGS. 34 and 35, the connecting members 33v can also be constructed in such a way that they can be connected to the connecting portions by means of a preferably self-locking plug connection. In the represented embodiment, each connecting member 33v is formed by an approximately U-shaped sheet metal profile, whose leg directed towards the front of the connecting piece 31v has a plugging or insertion opening for the particular connecting portion. This opening can be bounded by a barb-like locking member 57v, which is so hooked in the connecting portion that it does not free the same counter to the plugging or insertion direction. In the other opposite leg of connecting member 33v is appropriately provided a plugging or insertion opening for a plug 58 fitted to the appliance line 34v in such a way that the latter can be detachably inserted. Immediately adjacent to their associated ends or plugs 58, all the appliance lines 34v are fixed in positionally correct manner to a web-like joining part 59, so that they can be jointly connected as a block to connecting piece 31v.

Figure 36:
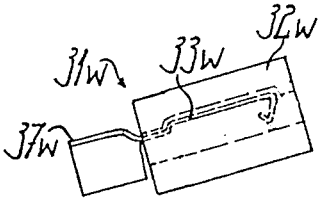
FIG. 36 is another embodiment of a connecting piece in side view.

The embodiment according to FIG. 36 differs therefrom essentially in that the front ends of the connecting members 33w associated with the connecting portions are formed by angle profiles 37w or similar threading and guidance means located freely in front of the insulator 32w, so that the connecting portions can be connected by welding.

In the embodiment according to FIGS. 37 and 38 parts are provided on hotplate 1y which project over the underside of cover 9y, so that the hotplate is essentially only suitable for stacking with displaced central axes 6y. For fixing hotplate 1y in the appliance is provided a threaded bolt 11y projecting downwards in central axis 6y and which is screwed into the centre stud of the hotplate body 2y and on which is placed a nut for securing cover 9y with respect to the hotplate body. Cover 9y is entirely located within the flange edge 5y and is tensioned in cup-shaped manner with a vertical edge within the flange rim 5y against the underside of the hotplate body or the zone having the heating resistor 7y. To prevent the hotplate turning in the appliance and which in the other embodiments can be brought about by a part projecting out of the transporting position over the underside of the hotplate, in the embodiment according to FIGS. 37 and 38 there is at least one turning preventing bolt 29 located adjacent to bolt 11y and projecting over the underside. Above the connecting portions 19y is provided a mating connector 30 in the form of a sheet metal profile projecting freely and which is parallel thereto and which is optionally traversed by insulating member 20y and is fixed to the underside of cover 9y, e.g. by spot welding. The cross-sectionally optionally U-shaped or tongue-like, flat mating connector 30, whose free end projects less far outwards than the connecting portions 19y, has its plugging portion at a distance below cover 9y, said portion having roughly the same plugging direction as the connecting portions 19y. The mating connector 30, which can be used in place of the positioning member 28 in the flange edge 5y for the positionally correct alignment of the electric hotplate 1y, is used for mounting a connecting piece 31y, which simultaneously has connecting members 33y for receiving the connecting portions 19y.

FIGS. 37 and 38 show the association of connecting piece 31 to the electric hotplate 1y or the mating connector 30, connecting piece 39y essentially corresponding to that of FIGS. 29 to 31. Connector 56y can be arranged in such a way that it receives between its relatively low legs directed away from the underside of the hotplate the mating connector 30 and is consequently secured with respect to the latter against lateral displacements. According to FIG. 38, locking members 50y can be provided on connector 56y and they cooperate with corresponding mating members (not shown) in the mating connector 30. By means of connector 56y, which can also engage with the mating connector 30 before connecting members 33y engage with the connecting portions 19y, connecting members 33y are very accurately aligned with respect to connecting portions 19y in two coordinate directions at right angles to one another. On the free end of mating connector 30 is provided a plate-like centering member 60 constructed in one piece with the mating connector 30 for all the connecting portions 19y. In the centering position, centering member 60 is in a roughly rectangular plane to the connecting portions 19y and projects downwards away from electric hotplate 1y. Centering member 60, which on its lower longitudinal edge has a prismatic or V-shaped centering opening 61 for each connecting portion 19y and which in the vicinity of said longitudinal edge forms a wider opening 62 than the remaining width of centering opening 61, engages on the connecting portions 19y with a limited spacing behind the free ends thereof. In the vicinity of its end remote from the centering openings 61, centering member 60 is connected in one piece with the front end of mating connector 30 over an articulation zone 63 in the form of relatively weakly dimensioned connecting webs. The articulation axis is located in the plane of the underside of mating connector 30, so that the centering member 60 can be folded against said underside. The connecting portions 19y pass through openings 62 out of the centering openings 61. Connector 56y of connecting piece 31y can be shortened with respect to connecting members 33y in such a way that the latter firstly engage with the connecting portions 19y. Subsequently the connecting members 33y and in particular connector 56y strike against the centering member 60, so that the latter is flapped back against the underside of mating connector 30 and is then located between said underside and connector 56y and there can be no electrical bridging of the connecting members 33y. Thus, in this case connector 56 is located on the underside of mating connector 30. Also in the case of the embodiment according to FIGS. 37 to 39, hotplate 1y can be made substantially continuously planar on the underside in a transportation and assembly state. After joining hotplate and hob, e.g. the centering member 60 is set up from its position flapped against the underside of the mating connector 30, the connecting portions 19y are pivoted into the connecting position about their articulations from the transportation and assembly position thereof and are precisely aligned in the centering openings 61. The gripper of a robot or the like used for assembly purposes can have a corresponding counter centering member, which has similar, prismatic centering openings for each connecting portion 19y and engages on said connecting portions 19y in the vicinity of centering member 60 and facing the centering opening 61 thereof, so that said portions are held immovably in the centering position. The gripper can also have both centering members on two oppositely directed centering jaws, so that there is no need for the centering member 60 provided on the hotplate.

The features described in connection with the embodiments can also be provided in all the other embodiments, as a function of the requirements which have to be fulfilled in each particular case. Particularly when used on a so-called automatic hotplate, in which a heat sensor is provided in an opening in the center of the hotplate body, there are appropriately two hollow screws positioned outside the central axis of the hotplate and spaced therefrom and having an internal thread corresponding to the hollow screw 11 according to FIGS. 1 and 2 serving both for fixing the cover and for fixing and preventing the rotation of the hotplate on the appliance. In place of the described connection possibilities between the connecting members 33 etc. and the appliance lines 34, in all embodiments it is possible to provide on the connecting members flat connecting tongues or plug junctions, as are conventionally marketed under the trade name AMP.

Instead of the alignment by means of the centering members 60 or additionally thereto, the aligning of the connecting portions, for example the connecting portions 19, 19y, respective 19z during the fitting respective the assembling may take place also by the means of providing a separate aligning or centering tool 64 appropriately provided as a gripper for separately grip the connecting portions 19z, so that these are as well aligned parallel to each other as held in predetermined distances with respect to each other. The tool according to FIG. 40 and 41 comprises two comb-shaped gripping jaws 65, 66, to be brought into an intermeshing engagement, which either are positioned directly adjacent behind each other and overlap each other or from which a thicker gripping jaw has a reception slot on its comb edge for receiving the other, thinner respective plate-like gripping jaw. The gripping jaws 65, 66 are provided with gripping cutouts 67 formed and arranged according to the centering member 60 and facing each other with their open sides, the gripping cutouts, for example, having convex curved flanks funnel-like narrowed to their bottom faces, whereby the bottom faces substantially correspond to the half cross-section of connecting portions 19z. The gripping jaws 65, 66 project freely from one end respective from a gripper holding means 68 in a direction in which the gripping cutouts 67 are provided adjacent to each other and are mounted movable towards and away from each other with respect to the gripper holding means 68. In the embodiment shown in the drawings, only one gripping jaw 65 is mounted movable for closing the tool while the other gripping jaw 66 is fixedly attached to the gripper holding means 68. In engagement with the respective movable gripping jaw 65, there is provided a setting member 70, for example, formed by a setting rod guided on a rod-like jaw guide 69. The tool 64 is moved in opened condition from a lateral position in such a way into the connecting portions (19z), that these come to lie between the gripping jaws 65, 66 and that between each two adjacent connecting portions 19z, the two corresponding comb teeth will be arranged, these comb teeth being oppositely disposed with respect to each other and lying between two adjacent gripping cutouts 67 of the respective gripping jaw 65, 66, thereby forming the flanks of the gripping cutouts 67. During transferring the tool into the closing position according to FIG. 41 the connecting portions 19z slide on the flanks of the gripping cutouts 67 until they lie in contact with the two oppositely disposed bottom faces of two oppositely disposed gripping cutouts 67 and are held substantially free from motion play by clamping. Since the free ends of the connecting portions 19z project over the tool 64 these ends can adapt their position still by a small amount and resiliently with respect to the position of the connecting piece or the position of the connecting members during threading into the connecting piece.

While in the embodiment according to FIG. 40 and 41 the gripping jaws 65, 66 are movable linearly with respect to each other, the gripping jaws 65z, 66z in the embodiment according to FIG. 42 are pincer-like swivel-mounted with respect to each other. For this purpose, both of the gripping jaws 65z, 66z form plier arms elongated beyond the gripping openings or gripping cutouts 67z, the plier arms being turnable mounted on each other as well as on the gripper holding means 68z about an axis parallel to the middle axis of the gripping cutouts 67z in a hinge 69z provided at their ends positioned at a distance from the gripping cutouts 67z. There also may be separate pincers provided for each connecting portion so that several pincers arranged adjacent to each other can engage into the connecting portions from the bottom side of the electric hotplate and at right angles thereto. In this case, the pincers can catch the connecting portions very closely to the insulating member since the pincers need only very little space between the connecting portions and the bottom side of the electric hotplate.

What is claimed is:

1. An electric hotplate, comprising:

a hotplate body (2) defining an outer circumference and an underside providing a stacking side for supporting said hotplate in a stacking condition in a hotplate stack, an insulating member (20) provided for passing heating resistor connecting leads (17) in a vicinity of said underside to form outer accessible connecting portions (19) of said connecting leads (17) having connecting ends constructed for connecting appliance lines (34) and adapted to be transferred between a stacking position and a connecting position, wherein in said stacking position the outer connecting portions (19) of the connecting leads (17) are located in a region extending from above said underside substantially at most to said underside of the hotplate body (2), said outer connecting portions (19) extending substantially parallel to said underside in said stacking position and providing inherently rigid, but resiliently movable connecting pins in said connecting positions.

2. An electric hotplate according to claim 1, wherein in the stacking position the connecting portions (19*b*) of the connecting leads (17*b*) in a top view of the hotplate body (2*b*) extend at most up to the outer circumference of the hotplate body, thereby providing a mounting position for mounting the hotplate in a hob.

3. An electric hotplate according to claim 1, wherein in the stacking position the connecting portions (19*b*) of the connecting leads (17*b*) in a top view of the hotplate body (2*b*) extend at most up to an inner circumference of an outer flange projection (5*b*) of said hotplate body (2).

4. An electric hotplate according to claim 1, wherein the particular connecting portion (19*a*) is mounted transferable out of the stacking position into a connecting position by means of at least one articulation (22*a*).

5. An electric hotplate according to claim 4, wherein the hinge is constructed in one piece with said connecting portion.

6. An electric hotplate according to claim 1, wherein in said connecting position the connecting portion projects over the outer circumference of the body.

7. An electric hotplate according to claim 1, wherein in said connecting position the connecting portion projects over the underside of the hotplate.

8. An electric hotplate according to claim 1, wherein the particular connecting portion (19*b*) is applied by means of a spring (71) substantially in a direction of a connecting position against a stop (72) on the underside of the hotplate, said stop holding said connecting portion in the stacking position.

9. An electric hotplate according to claim 8, wherein the spring (71) is constructed in one piece with the connecting portion (19*b*).

10. An electric hotplate according to claim 8, wherein the spring (71) forms a hinge.

11. An electric hotplate according to claim 4, wherein the hinge is formed by a helical bent part of the connecting portion (19*b*).

12. An electric hotplate according to claim 4, wherein at least one hinge is formed by a cross-sectionally reduced bend of the connecting portion (19*a*).

13. An electric hotplate according to claim 4, wherein an hinge axis of at least one hinge is substantially at right angles to the underside of hotplate (1*b*).

14. An electric hotplate according to claim 4, wherein an hinge axis of at least one hinge (22*a*) is substantially parallel to the underside of the hotplate.

15. An electric hotplate according to claim 4, wherein an hinge axis of at least one hinge is substantially at right angles to an associated axial plane of hotplate (1*a*).

16. An electric hotplate according to claim 1, wherein the connecting portion (19*k*) has, adjacent to the insulating member, a bending part defining a bending hinge.

17. An electric hotplate according to claim 16, wherein the bending part is formed by two cross-sectionally weakened portions (52) on either side of a bending point.

18. An electric hotplate according to claim 1, wherein from said stacking position the connecting portions are at least substantially transferable into a position at right angles to the hotplate.

19. An electric hotplate according to claim 4, wherein at least one hinge (22*a*) is positioned substantially in a depression on the underside of insulating member (20*a*).

20. An electric hotplate according to claim 4, wherein at least one hinge is positioned substantially in a reception depression (27*b*) on an underside of a lower cover (9*b*) of said hotplate body.

21. An electric hotplate according to claim 20, wherein the reception is provided between the insulating member (20*b*) and a ring rim (10*b*) of the lower cover (9*b*) engaging below an outer flange protection (5*b*) of the hotplate body (2*b*).

22. An electric hotplate according to claim 8, wherein the stop (72) for the connecting portion (19*b*) is provided on a lower cover (9*b*) of said hotplate body.

23. An electric hotplate according to claim 21, wherein a stop (72) for holding the connecting portions in said stacking position is formed by an inside of the ring rim (10*b*) of the lower cover (9*b*) of said hotplate body.

24. An electric hotplate according to claim 1, wherein for a part of the connecting portion (19) located between the insulating member (20) and the outer circumference of the hotplate body (2), a reception depression (27) is provided in the underside of the hotplate.

25. An electric hotplate according to claim 24, wherein the reception depression is formed slot-like.

26. An electric hotplate according to claim 1, wherein in an underside of the insulating member (20) passing through a lower cover (9) of said hotplate body and extending down substantially to an underside of said lower cover is provided a depression for receiving at least a part of the connecting portion (19*b*).

27. An electric hotplate, comprising:

a hotplate body (2) defining an outer circumference and an underside;

an insulating member (20) passed through by heating resistor connecting leads (17), outer connecting portions (19) of said connecting leads (17) having ends constructed for connecting appliance lines (34); and, a common connecting piece (31) for electrically connecting to all said connecting portions (19*b*) when connecting said appliance lines, said connecting piece (31) having separate connecting members (33) juxtaposed on an insulator (32), and wherein aligning and guidance means for adjusting the connecting portions (19*b*) with respect to the connecting members during connecting approach are located in a vicinity of front ends of the connecting members, said connecting portions being laterally resiliently movable by said aligning and guidance means.

28. An electric hotplate according to claim 27, wherein the connecting members (33*i*) form connector sockets for the connecting portions (19*i*), in a vicinity of a front end at least one of said connector sockets having a cross-sectional shape forming said aligning and guidance means.

29. An electric hotplate according to claim 27, wherein the insulator (32*i*) forms connector sockets for the connecting portions (19*i*), in a vicinity of a front end at least one of said connector sockets having a cross-sectional shape forming said aligning and guidance means.

30. An electric hotplate according to claim 27, wherein a front end of a socket opening (36*r*) of the aligning and guidance means is widened in funnel-shaped manner.

31. An electric hotplate according to claim 27, wherein a front end of a socket opening of at least one connecting member is formed by a tubular connecting member (33*r*).

32. An electric hotplate according to claim 27, wherein a front end of a socket opening of at least one connecting member is formed by an socket-like connecting member (33*r*), provided with at least one slot in a length direction of said connecting member.

33. An electric hotplate according to claim 27, wherein at least one socket opening (36*t*) of said connecting piece (31*t*) is slot-like and extending substantially at right angles to a common plane of the connecting portions.

34. An electric hotplate according to claim 27, wherein in front of a socket opening (36*i*) of at least one connecting member is provided at least one guide surface (40, 41, 42) for the connecting end of the connecting portion (19*i*), said guidance surface being substantially parallel to a plugging direction (48) and wider than a width extension of the socket opening (36*i*), said plugging direction being determined by a plugging movement for connecting said connecting piece.

35. An electric hotplate according to claim 34, wherein one guide surface (40) is substantially parallel to a common plane of the connecting portions (19*i*) and facing away from the underside of said hotplate.

36. An electric hotplate according to claim 34, wherein one guide surface (41) is substantially at right angles to a common plane of the connecting portions (19*i*), two guide surfaces (40, 41) being provided at an angle to one another and being connected together.

37. An electric hotplate according to claim 34 wherein at least one guide surface (40, 41, 42) is formed by the connecting member (33*i*) having a front end forming a guide profile.

38. An electric hotplate according to claim 34, wherein at least one guide surface (40*n*) is formed by the insulator (32*n*).

39. An electric hotplate according to claim 34, wherein at least one guide surface (40*n*) is formed by a shoulder surface extending past all the connecting members (33*n*).

40. An electric hotplate according to claim 27, wherein the insulator (32, 32*i*, 32*m*) of the connecting piece (31, 31*i*, 31*m*, 31*y*) is connected to at least one aligning member provided to engage on the hotplate (1*b*, 1*y*) in the vicinity of the underside.

41. An electric hotplate according to claim 40, wherein the aligning member is formed by projecting studs for engagement in depressions (51) on an underside of a lower cover (9*i*) of said hotplate body.

42. An electric hotplate according to claim 40, wherein aligning members are provided on either side of the connecting portions (19*i*).

43. An electric hotplate according to claim 40, wherein the aligning member is formed by a stop (50*m*) for engagement on an outer circumference of an outer flange projections of the hotplate body in a mounted stop position.

44. An electric hotplate accroding to claim 27, wherein the insulator (32*m*) of the connecting piece (31*m*) supported on an underside of an outer flange projection of said hotplate body in a mounted stop position.

45. An electric hotplate according to claim 40, wherein the aligning member is formed by a connector plug (56*y*) substantially parallel to the connecting portions (19*y*) and associated with a mating connector (30) of the hotplate (1*y*).

46. An electric hotplate according to claim 45, wherein the connector plug (56*y*) is formed by a sheet metal profile carrying the insulator (32*y*), the mating connector (30) being formed by an insertion tongue located above the connecting portion (19*y*) and fixed to a lower cover (9*y*) of said hotplate body.

47. An electric hotplate according to claim 1, wherein a centering member (60) for at least one of said connecting portions (19*y*) is provided for engaging an associated connecting portion in the vicinity of said connection end, said centering member being arranged on the hotplate (1*y*).

48. An electric hotplate according to claim 47, wherein the connecting member (60) is movable from a centering position into a connecting position displaced out of an insertion path of the connecting piece (31*y*), said insertion path being provided for connecting said connecting piece to said connecting portions (19*y*).

49. An electric hotplate according to claim 48, wherein the centering member (60) is mounted for movement by the connecting piece (31*y*) out of said centering position upon movement of the connecting piece in a plugging and inserting direction.

50. An electric hotplate according to claim 48, wherein said centering member (60) is pivotably mounted about an axis substantially parallel to a common plane of the connecting portions (19*y*).

51. An electric hotplate according to claim 47, wherein said centering member (60) is arranged on a lower cover (9*y*) of said hotplate body.

52. An electric hotplate according to claim 47, wherein said centering member (60) is connected by means of at least one bending hinge (63) to a mating connector (30) provided for receiving a connector plug of said connecting piece (31*y*).

53. An electric hotplate according to claim 47, wherein said centering member (60) has centering openings (61) for engaging the connecting portions (19*y*), said centering openings being open at an edge of the centering member (60), thereby forming escape openings (62) for the connecting portions (19*y*).

54. An electric hotplate according to claim 53, wherein said escape openings are provided on an edge of said centering member (60) remote from a hinge zone (63), the centering member (60) having the shape of a plate.

55. An electric hotplate according to claim 27, wherein said connecting piece (31*i*) has at least one positioning member (45) for a positionally correct alignment on a gripper of a robot means.

56. An electric hotplate according to claim 55, wherein said positioning member (45) is substantially formed by positioning depressions provided on either side of the insulator (32*i*).

57. An electric hotplate according to claim 27, wherein said connecting members (33*i*) are made from steel.

58. An electric hotplate according to claim 27, wherein said connecting members (33*i*) are formed by multicore cable ends provided for connection to said appliance lines (34*i*).

59. An electric hotplate according to claim 27, wherein said connecting members (33*m*) are positionally secured with respect to said insulator (32*m*) by crimping, the insulator being provided in the vicinity of each connecting member (33*m*) with at least one engagement opening (53*m*) for a crimping tool, said engagement opening (53*a*) being located substantially at right angles to said connecting member.

60. An electric hotplate according to claim 27, wherein said connecting member (33*i*) is constructed for non-contact welding to the connecting portion (19*i*), the insulator (32*i*) having welding access openings (49) in a vicinity of welding points.

61. An electric hotplate according to claim 27, wherein said connecting member (33*m*) is constructed for crimped connection to at least one of members formed by the connecting portions and the appliance line (34*m*).

62. An electric hotplate according to claim 27 wherein the connecting member (33*v*) is constructed for being detachably plug connected to at least one of members provided by the connecting portions and a plug (58) of the appliance line (34*v*).

63. An electric hotplate according to claim 27, wherein a connecting member (33*t*) for at least one of members formed by said connecting portions and said appliance line (34*t*) has at least one connecting clamping screw (57, 55*t*), said connecting member (33*t*) having an oval socket cross-section, a thread of the clamping screw engaging in opposite longer cross-sectional flanks of the connecting member (33*t*) and being positioned substantially parallel to said flanks.

64. An electric hotplate according to claim 27, wherein connecting ends of said connecting members (33) are flat connection tongues.

65. An electric hotplate according to claim 27, wherein at least one of said front ends of the connecting members (33*i*) projects beyond the insulator (32*i*) in a plugging and insertion direction, said front end being provided for extending substantially up to a bend (22*i*) of the connecting portion (19*i*) in a mounted condition.

66. An electric hotplate according to claim 27, wherein said insulator (32*i*) is elongated in a longitudinal direction of the connecting members (33*i*), each connecting member being constructed in one piece, the insulator being provided for projecting outwards beyond said circumference of the hotplate body by a part of its overall length in a mounted position.

67. An electric hotplate according to claim 27, wherein in a mounted condition said insulator (32) substantially connects to at least one of faces provided by a facing outer lateral face and an underside of the insulator member.

68. An electric hotplate according to claim 27, wherein in a mounted condition said insulator (32) receives an associated hinge (71) of at least one connecting portion.

69. An electric hotplate according to claim 27, wherein at least one of members provided by said insulator (32) and said insulating member (20*b*) is made from a ceramic material.

70. An electric hotplate according to claim 1, wherein said insulating member (20) is positionally secured between a lower cover (9) of said hotplate body and a facing underside of the hot body (2) receiving an electric heating resistor (7), said insulating member (20) engaging in centered manner in a window-like opening (23) in said lower cover (9).

71. An electric hotplate according to claim 1, wherein the insulating member (20) is set back with respect to an underside of a lower cover (9) of said hotplate body (2).

72. An electric hotplate according to claim 1, wherein said insulating member (20) has narrow passage openings (21) for securing said connecting leads (17) against movement of inner portions (18) connected to a heating resistor (7) of said hotplate body.

73. An electric hot according to claim 1, wherein the underside of a lower cover (9) of said hotplate body is constructed as a stacking surface substantially located in one plane, said underside being substantially free from projecting parts.

74. An electric hotplate according to claim 1, wherein a lower cover (9) is fixed to the hotplate body (2) by at least one fixing member (11) set back with respect to an underside of said lower cover (9).

75. An electric hotplate according to claim 74, wherein the fixing member is provided outside a central axis (6) of the hotplate (1) in the vicinity of an inner flange projection (70) of the hotplate body (2).

76. An electric hotplate according to claim 1, wherein the hotplate, constructed as an automatic hotplate, is provided on said underside with two spaced fixing bolts for fixing the hotplate body to at least one of members provided by a lower cover for the hotplate body and a hob adapted to receive said hotplate.

77. An electric hotplate according to claim 76, wherein at least one fixing bolt is a hollow screw.

78. An apparatus for fitting an electrical connecting piece to connecting portions of an electric hotplate, wherein a gripper is provided for moving the connecting piece (31*i*) in three coordinate directions (arrows 46, 47, 48) with respect to the connecting portions (19*i*), thereby successively engaging the connecting portions with guide surfaces (40, 41, 42).

* * * * *

UNITED STATES PATENT AND TRADEMARK OFFICE

CERTIFICATE OF CORRECTION

PATENT NO. : 4,871,902

DATED : October 3, 1989

INVENTOR(S) : Kicherer

It is certified that error appears in the above-identified patent and that said Letters Patent is hereby corrected as shown below:

IN THE SPECIFICATION:

Column 3, line 48, delete "redetachable".

IN THE CLAIMS:

Claim 4 (Column 19, line 22), delete "articulation" and insert --hinge--.

Claim 6 (Column 19, line 28), insert --hotplate-- before the word "body".

Claim 21 (Column 20, line 14), delete "protection" and insert --projection--.

Claim 44 (Column 21, line 68), insert --is-- before the word "supported".

Claim 46 (Column 22, line 9), delete "is" and insert --being--.

Claim 65 (Column 23, line 39), insert --(arrow 48)-- after the word "direction".

Signed and Sealed this

Twelfth Day of February, 1991

*Attest:*

*Attesting Officer*

HARRY F. MANBECK, JR.

*Commissioner of Patents and Trademarks*